US007221883B2

(12) United States Patent
Iwakura et al.

(10) Patent No.: US 7,221,883 B2
(45) Date of Patent: May 22, 2007

(54) ELECTROSTATIC IMAGE TRANSFER DEVICE USING INTERMEDIATE TRANSFER BELT HAVING SIMPLIFIED IMAGE TRANSFER VOLTAGE REQUIREMENTS

(75) Inventors: Yoshie Iwakura, Higashiosaka (JP); Susumu Murakami, Soraku-gun (JP); Takahiro Fukunaga, Sakurai (JP); Kuniaki Nakano, Soraku-gun (JP); Hideshi Izumi, Ikoma (JP); Minoru Tomiyori, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 11/021,293

(22) Filed: Dec. 22, 2004

(65) Prior Publication Data

US 2005/0141912 A1 Jun. 30, 2005

(30) Foreign Application Priority Data

Dec. 26, 2003 (JP) ..... P2003-435394

(51) Int. Cl.
*G03G 15/16* (2006.01)

(52) U.S. Cl. ..... 399/66; 399/314

(58) Field of Classification Search ..... 399/66, 399/314

See application file for complete search history.

(56) References Cited

U.S. PATENT DOCUMENTS 6,324,359 B1 11/2001 Nakane
6,510,295 B2 * 1/2003 Noguchi et al. ..... 399/66
6,904,255 B2 * 6/2005 Kera et al. ..... 399/299

FOREIGN PATENT DOCUMENTS

| | | |
|---|---|---|
| JP | 10-039651 | 2/1998 |
| JP | 10-142893 | 5/1998 |
| JP | 2000-242096 | 9/2000 |

* cited by examiner

*Primary Examiner*—Walter Benson
(74) *Attorney, Agent, or Firm*—David G. Conlin; David A. Tucker; Edwards Angell Palmer & Dodge LLP

(57) ABSTRACT

A transfer device has a control circuit. The control circuit initiates supplying transfer power to one or more first transfer rollers and to a second transfer roller when a first transfer operation is initiated by a first transfer roller positioned most upstream with respect to a direction in which an intermediate transfer belt travels. The control circuit stops supplying the transfer power to the one or more first transfer rollers and to the second transfer roller when a second transfer operation is completed by the second transfer roller. The transfer power supplied to the one or more first transfer rollers and to the second transfer roller, respectively, is free from fluctuation during a period from the initiation of the first transfer operation performed first to the completion of the second transfer operation.

6 Claims, 5 Drawing Sheets

ELECTROSTATIC IMAGE TRANSFER DEVICE USING INTERMEDIATE TRANSFER BELT HAVING SIMPLIFIED IMAGE TRANSFER VOLTAGE REQUIREMENTS

CROSS REFERENCE

This Nonprovisional application claims priority under 35 U.S.C. § 119(a) on Patent Application No. 2003-435394 filed in Japan on Dec. 26, 2003, the entire contents of which are hereby incorporated by reference.

BACKGROUND OF THE INVENTION

The present invention relates to a transfer device for use in an electrophotographic image forming apparatus in which a toner image as formed on an image carrier is firstly transferred to an endless intermediate transfer belt and the toner image is secondly transferred from the intermediate transfer belt to a record medium such as a sheet of paper (hereinafter referred to merely as a sheet). The present invention relates in particular to a transfer device which controls transfer power to be supplied in first and second transfer operations.

Japanese Patent Application Laid-Open No. H10-039651 discloses a tandem-type full-color image forming apparatus having a semiconductive endless belt and a plurality of (e.g. four) image forming sections. The endless belt is installed rotatably, and the image forming sections each provided for forming a developed image of corresponding color are aligned along an outer circumference of the endless belt. This arrangement allows a full-color image to be formed in at least one full rotation of the endless belt.

There is also known a tandem-type full-color image forming apparatus using an intermediate transfer method. In the image forming apparatus, developed images for respective colors formed on photoreceptor drums as image carriers in respective image forming sections are accumulated on an outer circumferential surface of an endless belt (an intermediate transfer belt) and then transferred to a sheet, to form a full-color image.

More specifically, toner images are formed on the image carriers in the respective image forming sections, based on image data for the respective colors obtained by color separation from an original image. The toner images are firstly transferred from the image carriers to the intermediate transfer belt to be accumulated, or first transfer operations are performed. Then, the accumulation of toner images is secondly transferred from the intermediate transfer belt to the sheet, or a second transfer operation is performed.

Accordingly, the formation of a full-color image involves the first transfer operations performed in a plurality of, for example four, first transfer regions, and the second transfer operation performed in a second transfer region other than the first transfer regions. While following a loop travel path, the intermediate transfer belt passes through the first transfer regions and the second transfer region, in the order.

In the image forming apparatus using the intermediate transfer method, transfer power in full-color image formation is supplied to the intermediate transfer belt in the first transfer regions and in the second transfer region. The transfer power supplied to one of the transfer regions has undesirable effects on another transfer region positioned downstream thereof through the intermediate transfer belt, thereby preventing a predetermined transfer power from being supplied to the transfer region positioned downstream.

This is particularly true in case of the second transfer region being positioned immediately downstream of the first transfer region provided most downstream with respect to a traveling direction of the intermediate transfer belt with an aim to downsize the apparatus and achieve high-speed image formation. As a result, a toner image on the intermediate transfer belt cannot be transferred properly to a sheet.

Since a black toner image is generally transferred to the intermediate transfer belt in the first transfer region positioned most downstream with respect to the traveling direction, the transfer power supplied to the first transfer region interferes with the transfer operation in the second transfer region, in monochromatic image formation as well.

There have been proposed solutions to the foregoing problem, such as arrangement of first and second transfer regions at a longer distance from each other or use of an intermediate transfer belt with a higher resistance.

However, such arrangement of the first and second transfer regions causes an increase in size, and a decrease in image formation speed, of an image forming apparatus. Also, the intermediate transfer belt with a higher resistance requires a discharging device for each of the transfer regions, resulting in an increase in size and in manufacturing costs of the apparatus.

A feature of the present invention is to offer a transfer device that controls transfer power supply so that transfer power is timely supplied to the intermediate transfer belt in first and second transfer regions. Simple timing control allows the transfer device to avoid the undesirable effects of transfer power supplied to the respective transfer regions on the transfer operations performed in the other transfer regions. The transfer device thereby allows uniform transfer operations to be performed in the respective transfer regions and therefore constant high-quality image formation to be achieved, without an increase in size, or a decrease in image formation speed, of the image forming apparatus.

SUMMARY OF THE INVENTION

A transfer device of the present invention includes an endless intermediate transfer belt following a loop path; an image carrier for a toner image to be formed in an electrophotographic method; and a control section for controlling first and second transfer operations performed in one full rotation on the loop path of the intermediate transfer belt by supplying a predetermined level of transfer power to each of one or more first transfer regions where the toner image is transferred from the image carrier to the intermediate transfer belt and to a second transfer region where the toner image is transferred from the intermediate transfer belt to a record medium.

DETAILED DESCRIPTION OF THE INVENTION

Figure 1:
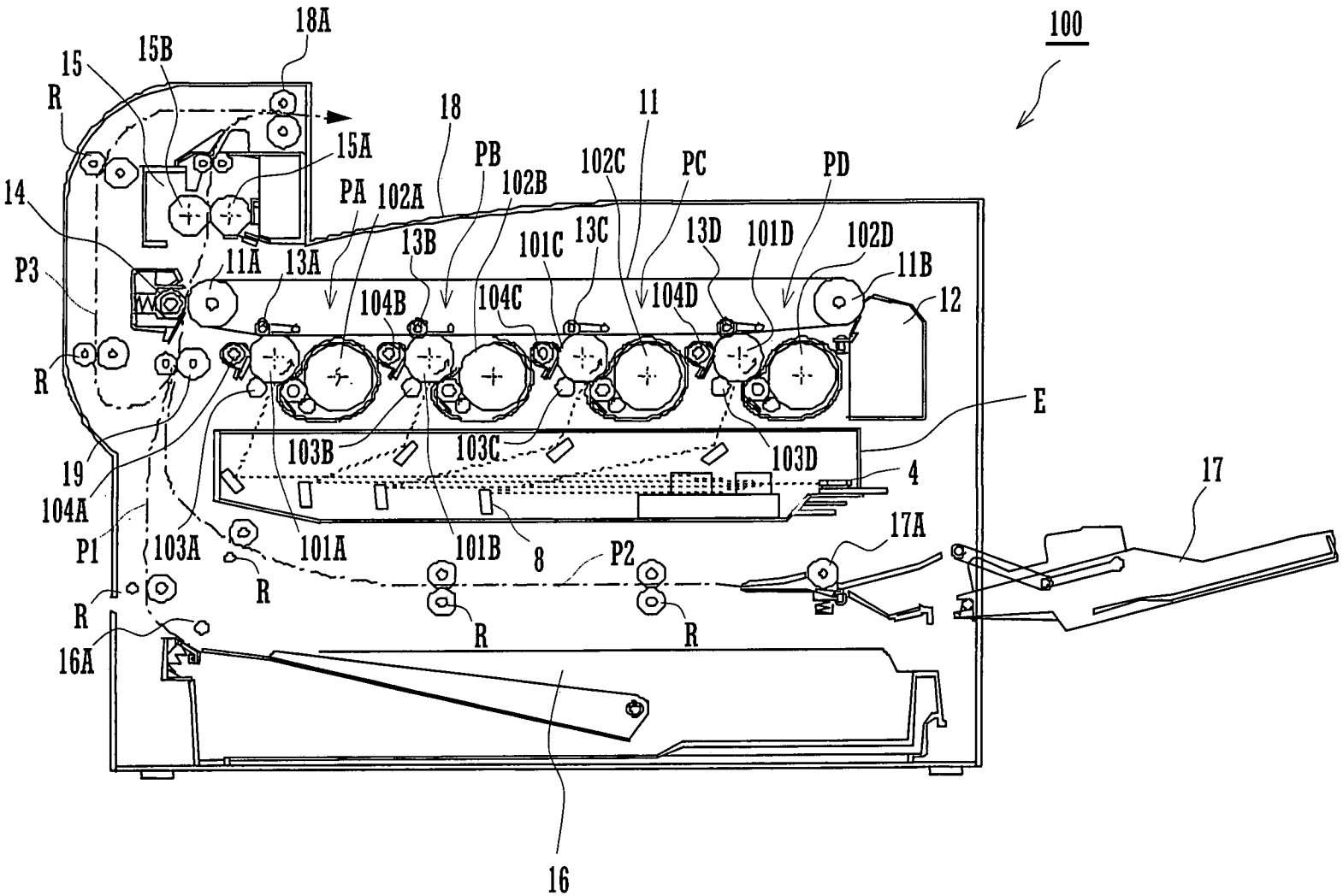
FIG. 1 is a cross-sectional view illustrating a construction of an image forming apparatus including a transfer device according to a first embodiment of the present invention.

FIG. 1 is a cross-sectional view illustrating a construction of an image forming apparatus including a transfer device according to a first embodiment of the present invention. An image forming apparatus 100 forms a multi-color or monochromatic image on a record medium such as a sheet of paper (hereinafter referred to merely as a sheet) based on image data transmitted externally. The image forming apparatus 100 has an exposure unit E, four photoreceptor drums (image carriers of the present invention) 101A to 101D, four developing units 102A to 102D, four charging rollers 103A to 103D, four cleaning units 104A to 104D, an intermediate transfer belt 11, four first transfer rollers 13A to 13D, a second transfer roller 14, a fusing device 15, sheet transport paths P1, P2, and P3, a sheet feed cassette 16, a manual sheet feed tray 17, and a sheet catch tray 18.

The transfer device of the present invention includes the intermediate transfer belt 11, the first transfer rollers 13, and the second transfer roller 14.

The image forming apparatus 100 forms an image based on image data obtained by color separation from an original color image. The image data correspond to four colors, i.e. the three subtractive primary colors—yellow (Y), magenta (M), and cyan (C)—and black (K), respectively. There are four image forming sections PA to PD provided correspondingly to the four colors. The photoreceptor drums 101A to 101D, the developing units 102A to 102D, the charging rollers 103A to 103D, the first transfer rollers 13A to 13D, and the cleaning units 14A to 14D are provided, one each in each of the four image forming sections PA to PD. The image forming sections PA to PD are aligned in a direction in which the intermediate transfer belt 11 travels (or a sub scanning direction).

The charging rollers 103A to 103D are contact-type chargers provided for charging respective outer circumferential surfaces of the photoreceptor drums 101A to 101D uniformly so that the surfaces have a predetermined potential. The charging rollers 103A to 103D are replaceable with a contact-type charger using a charging brush or with a noncontact-type charging device. The exposure unit E has a not-shown semiconductor laser, a polygon mirror 4, and reflecting mirrors 8. The exposure unit E shines laser beams modulated depending on the image data for the four colors of black, cyan, magenta, and yellow on the photoreceptor drums 101A to 101D, respectively. Latent images corresponding to the four colors are thus formed on the photoreceptor drums 101A to 101D, respectively.

The developing units 102A to 102D feed the respective surfaces of the photoreceptor drums 101A to 101D carrying the latent images with toners, so that the latent images are developed into toner images. More specifically, the developing units 102A to 102D store therein black, cyan, magenta, and yellow toners, respectively, and develop the latent images formed on the photoreceptor drums 101A to 101D into black, cyan, magenta, and yellow toner images, respectively. The cleaning units 104A to 104D remove and collect residual toners on the respective surfaces of the photoreceptor drums 101A to 101D after developing and transferring operations.

Arranged above the photoreceptor drums 101A to 101D, the intermediate transfer belt 11 is stretched over a drive roller 11A and a driven roller 11B to form a loop traveling path. As the intermediate transfer belt 11 travels, an outer circumferential surface thereof faces the photoreceptor drum 101D, the photoreceptor drum 101C, the photoreceptor drum 101B, and the photoreceptor drum 101A, in the order. The first transfer rollers 13A to 13D are positioned to face the photoreceptor drums 101A to 101D, respectively, through the intermediate transfer belt 11. First transfer regions of the present invention include the first transfer rollers 13A to 13D and the photoreceptor drums 101A to 101D, respectively. In the respective first transfer regions, a toner image is transferred from the drums 101A to 101D to the intermediate transfer belt 11.

The intermediate transfer belt 11 is an endless belt formed with a film of 100 μm to 150 μm thickness. The intermediate transfer belt 11 has a resistance of $1\times10^{11}$ to $1\times10^{13}$ Ω·cm. A lower resistance causes power leakage from the intermediate transfer belt 11, thereby preventing a sufficient level of transfer power for the first transfer operations from being maintained. A higher resistance requires a discharging device for discharging the intermediate transfer belt 11 each time after the belt 11 passes through the respective first transfer regions.

To the first transfer rollers 13A to 13D, a first transfer bias (or transfer power of the present invention) is applied at a constant voltage for transferring of the toner images as carried on the photoreceptor drums 101A to 101D onto the intermediate transfer belt 11. The first transfer bias is opposite in polarity to the charge of the toners. The toner images for the respective colors are thus transferred sequentially and accumulated on the outer circumferential surface of the intermediate transfer belt 11 to form a full-color toner image.

When image data for only some of the four colors are input, latent image(s) and toner image(s) are formed only on some of the photoreceptor drums 101A to 101D, depending on the input color image data. In monochromatic image formation, for example, a latent image and a toner image are formed only on the photoreceptor drum 101A corresponding to the color black. Accordingly, only a black toner image is transferred to the outer circumferential surface of the intermediate transfer belt 11.

Each of the first transfer rollers 13A to 13D includes a metal (e.g. stainless steel) shaft of 8 to 10 mm diameter. A surface of the metal shaft is coated with conductive elastic material (e.g. EPDM or urethane foam), through which a high voltage is uniformly applied to the intermediate transfer belt 11. The first transfer rollers 13A to 13D are replaceable with brush-type transfer members.

In addition, the first transfer rollers 13A to 13D are biased toward the photoreceptor drums 101A to 101D, respectively, in a direction other than respective normal directions of the photoreceptor drums 101A to 101D.

The rotation of the intermediate transfer belt 11 feeds the full-color or monochromatic toner image as transferred to the outer circumferential surface of the belt 11 to a position where the belt 11 faces the second transfer roller 14 (i.e. a second transfer region of the present invention). In image formation, the second transfer roller 14 is pressed at a predetermined nip pressure against the outer circumferential surface of the intermediate transfer belt 11 where a reverse, inner circumferential surface of the belt 11 is in contact with the drive roller 11A. A high voltage opposite in polarity to the charge of the toners is applied to a sheet as fed from the sheet feed cassette 16 or from the manual sheet feed tray 17 as the sheet passes between the second transfer roller 14 and the intermediate transfer belt 11. The full-color or monochromatic toner image is thus transferred from the outer circumferential surface of the intermediate transfer belt 11 to a surface of the sheet.

To maintain the predetermined nip pressure, either one of the second transfer roller 14 and the drive roller 11A is a roller of hard material (i.e. metal), and the other is an elastic roller of soft material (i.e. elastic rubber or resin foam).

In some instances, some of the toners are not transferred to the sheet and remain on the intermediate transfer belt 11. The residual toners are collected by a cleaning unit 12 to avoid mixture of toners of different colors in subsequent image formation.

The sheet with the full-color or monochromatic toner image transferred thereto is led into the fusing device 15 and passes between a heat roller 15A and a pressure roller 15B to be heated and pressed. The toner image is thus firmly fixed to the surface of the sheet. The sheet with the fixed toner image is then ejected onto the sheet catch tray 18 by sheet eject rollers 18A.

The image forming apparatus 100 has the sheet transport path P1 leading approximately vertically from the sheet feed cassette 16, through a gap between the second transfer roller 14 and the intermediate transfer belt 11 and through the fusing device 15, to the sheet catch tray 18. Arranged along the sheet transport path P1 are a pick-up roller 16A, transport rollers R, registration rollers 19, and the sheet eject rollers 18A. The pick-up roller 16A feeds sheets as stored in the sheet feed cassette 16, sheet by sheet, into the sheet transport path P1. The transport rollers R transport a fed sheet upward. The registration rollers 19 lead the sheet between the second transfer roller 14 and the intermediate transfer belt 11 at a predetermined timing. The sheet eject rollers 18A eject the sheet onto the sheet catch tray 18.

The image forming apparatus 100 also has the sheet transport path P2 leading from the manual sheet feed tray 17 to the registration rollers 19. A pick-up roller 17A and transport rollers R are arranged along the sheet transport path P2. Also provided is the sheet transport path P3 leading from the sheet eject rollers 18A to upstream of the registration rollers 19 on the sheet transport path P1.

The sheet eject rollers 18A are rotatable in forward and backward directions. In single-side image formation, and in image formation on a second side of a sheet in double-side image formation, the sheet eject rollers 18A are rotated in the forward direction, so that the sheet is ejected onto the sheet catch tray 18. In image formation on a first side of the sheet in the double-side image formation, the sheet eject rollers 18A are first rotated in the forward direction until a tail end of the sheet passes through the fusing device 15. Then, with the tail end nipped therebetween, the eject rollers 18A are rotated in the backward direction to feed the sheet into the sheet transport path P3. Thus, in the double-side image formation, the sheet having an image formed on the first side thereof is fed into the sheet transport path P1, the tail end first, with the second side facing the side of the drive roller A.

The registration rollers 19 feed a sheet as fed either from the sheet feed cassette 16 or the manual sheet feed tray 17, or through the sheet transport path P3, between the second transfer roller 14 and the intermediate transfer belt 11 in synchronized timing with the rotation of the intermediate transfer belt 11.

At the time the photoreceptor drums 101A to 101D and the intermediate transfer belt 11 start rotating, the registration rollers 19 have their own rotation stopped. A sheet as fed or transported before the intermediate transfer belt 11 initiates rotating is stopped, with a leading end thereof in contact with the registration rollers 19.

Then, as the leading end of the sheet and a leading end of the toner image formed on the intermediate transfer belt 11 meet each other at the contact position of the second transfer roller 14 and the intermediate transfer belt 11, the registration rollers 19 initiate rotating.

In the image forming apparatus as illustrated in FIG. 1, the first transfer rollers 13A to 13D included in the respective first transfer regions are provided along a lower portion of the loop traveling path of the intermediate transfer belt 11. The image forming sections PA to PD including the rollers 13A to 13D are arranged in proximity to each other. The second transfer roller 14 is positioned immediately downstream of the first transfer roller 13A that is arranged most downstream with respect to a traveling direction of the intermediate transfer belt 11.

This positioning is aimed at achieving high-speed image formation as well as at downsizing the image forming apparatus in which a toner image is secondly transferred from the intermediate transfer belt 11 to a sheet as transported approximately vertically. The high-speed image formation is allowed by reducing time taken from initiation of first transfer process by the first transfer roller 13D positioned most upstream, to completion of second transfer process by the second transfer roller 14.

Consequently, transfer power supplied to the first transfer rollers 13A to 13D and the second transfer roller 14, respectively, are likely to interfere with each other through the intermediate transfer belt 11.

In the full color image formation involving toner image formation performed in all of the image forming sections PA to PD, the intermediate transfer belt 11 is pressed by all of the first transfer rollers 13A to 13D against the photoreceptor drums 101A to 101D, respectively. In the monochromatic image formation involving toner image formation performed only in the image forming section PA, the intermediate transfer belt 11 is pressed by only the first transfer roller 13A against the photoreceptor drum 101A.

Figure 2:
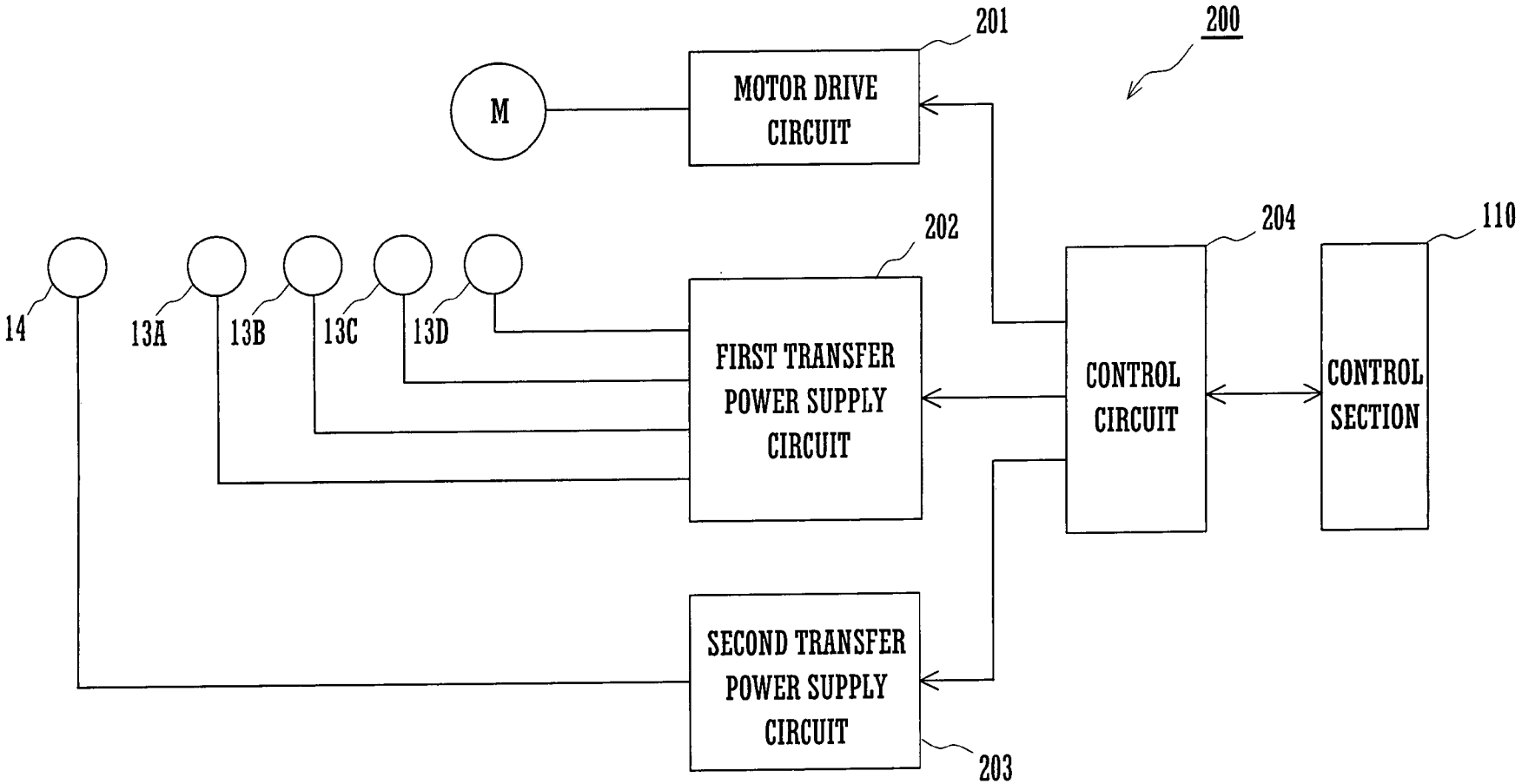
FIG. 2 is a block diagram illustrating a construction of the transfer device according to the first embodiment.

FIG. 2 is a block diagram illustrating a construction of the transfer device according to the first embodiment. A transfer device 200 of the present invention includes a motor drive circuit 201, a first transfer power supply circuit 202, a second transfer power supply circuit 203, and a control circuit 204. The control circuit 204 is connected to a control section 110 of the image forming apparatus 100. Upon receipt of input data from the control section 110, the control circuit 204 outputs, according to a predetermined program, driving data for a motor M, and data on transfer power to be supplied to the first transfer rollers 13A to 13D and to the second transfer roller 14A (hereinafter referred to merely as the transfer power data), to the motor drive circuit 201, the first transfer power supply circuit 202, and the second transfer power supply circuit 203, respectively.

According to the driving data output from the control circuit 204, the motor drive circuit 201 drives the motor M provided for rotating the drive roller 11A. According to the transfer power data output from the control circuit 204, the first transfer power supply circuit 202 supplies transfer power to each of the first transfer rollers 13A to 13D. According to the transfer power data output from the control circuit 204, the second transfer power supply circuit 203 supplies transfer power to the second transfer roller 14.

In the first transfer operations performed by the first transfer rollers 13A to 13D, a constant-voltage control allows stable supply of transfer power to the transfer rollers 13A to 13D. This is because a toner image is transferred to the intermediate transfer belt 11 that is relatively electrically stable. In the second transfer operation performed by the second transfer roller 14, in contrast, a constant-current control is required for stable supply of transfer power to the transfer roller 14. This is because the toner image is transferred to a sheet with electrical properties varying depending on the type, thickness, and moisture content thereof.

Thus, the first transfer power supply circuit 202 supplies a predetermined level of transfer power to each of the first transfer rollers 13A to 13D at a constant voltage. The second transfer power supply circuit 203 supplies a predetermined level of transfer power to the second transfer roller 14 at a constant current.

Figure 3:
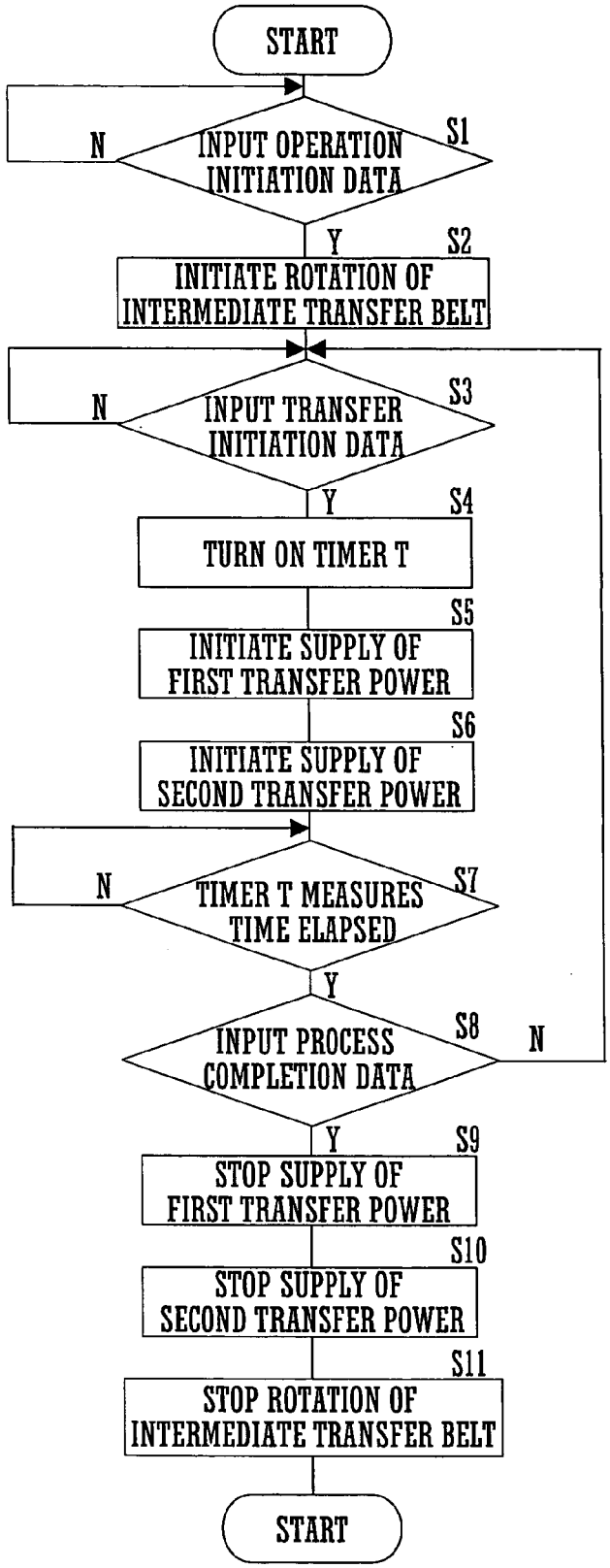
FIG. 3 is a flowchart illustrating processing steps performed in full-color image formation by a control circuit of the transfer device.

FIG. 3 is a flowchart illustrating processing steps performed in the full-color image formation by the control circuit of the transfer device. The control circuit 204 awaits input of operation initiation data from the control section 110 (step S1). The operation initiation data is used for specifying the timing of initiating an image forming operation. Upon input of the operation initiation data, the control circuit 204 outputs the driving data for the motor M to the motor drive circuit 201, thereby causing the intermediate transfer belt 11 to initiate traveling on the travel path (step S2).

Then, the control circuit 204 awaits input of transfer initiation data from the control section 110 (step S3). The transfer initiation data is used for specifying the timing of initiating a first transfer operation of a toner image formed on the photoreceptor drum 101D being transferred to the intermediate transfer belt 11 by the first transfer roller 13D in a first transfer region provided in the image forming section PD which is positioned most upstream with respect to the traveling direction of the belt 11.

Upon input of the transfer initiation data, the control circuit 204 turns on a timer T for measuring a predetermined time period (step S4). Then, the circuit 204 outputs the transfer power data to the first transfer power supply circuit 202 and to the second transfer power supply circuit 203 in order to initiate supplying transfer power to the first transfer rollers 13A to 13D and to the second transfer roller 14 (steps S5 and S6).

The predetermined time period to be measured by the timer T is time taken for the intermediate transfer belt 11 to travel a distance, plus a sheet length, from the first transfer roller 13A to the second transfer roller 14. More specifically, the timer T measures time elapsed from the initiation of the first transfer operation to the completion of the second transfer operation, in an image formation process performed on a sheet.

The control circuit 204 then waits until the timer T has measured the time elapsed (step S7). Next, the circuit 204 determines whether process completion data for indicating the completion of the image forming process is input from the control section 110 (step S8). When the image forming apparatus 100 has no subsequent image data to be processed and the process completion data is input from the control section 110, the control circuit 204 stops the first transfer circuit 202 and the second transfer circuit 203 from supplying the transfer power (steps S9 and S10), and stops the motor drive circuit 201 from driving the motor M (step S11).

As described above, the control circuit 204 initiates supplying the transfer power to the first transfer rollers 13A to 13D and to the second transfer roller 14 when the first transfer operation by the first transfer roller 13D is initiated. Then, the circuit 204 stops supplying the transfer power to the first transfer rollers 13A to 13D and to the second transfer roller 14 when the second transfer operation by the second transfer roller 14 is completed.

Accordingly, the transfer power supplied to the first transfer rollers 13A to 13D and the second transfer roller, respectively, is free from fluctuation during a period from the initiation of the first transfer operation by the roller 13D to the completion of the second transfer operation, even if the transfer power as supplied interfere with each other through the intermediate transfer belt 11. The first transfer operations and the second transfer operation are thus performed in a stable manner.

In the monochromatic image formation involving image formation performed only in the image forming section PA, the transfer power is supplied only to the first transfer roller 13A and not to the first transfer rollers 13B to 13D. In step S3, thus, the control circuit 204 awaits input of transfer initiation data for specifying the timing of initiating a first transfer operation of a toner image formed on the photoreceptor drum 101A being transferred to the intermediate transfer belt 11 by the first transfer roller 13A. In steps S5 and S9, respectively, the circuit 204 initiates, and stops, supplying transfer power only to the first transfer roller 13A.

Alternatively, in step S3, the control circuit 204 awaits input from the control section 110 of data for specifying the timing of initiating a developing operation in the image forming section in which the first transfer operation is first to be performed (i.e., the image forming section PD in the full-color image formation or the image forming section PA in the monochromatic image formation). The alternative allows earlier initiation of supplying the transfer power before the first transfer operation is first performed, thereby ensuring that the first transfer operation is performed at an appropriate level of transfer power, even if it takes some time for the transfer power to reach a predetermined level after the initiation of supply thereof.

Also, an appropriate level of transfer power to be supplied to the first transfer rollers 13B to 13D and to the second transfer roller 14 varies depending on environmental conditions such as temperature or humidity. Therefore, an absolute level of transfer power to be supplied is modulated according to the result of detection by a not-shown environmental sensor.

Additionally, in consecutive image formation where a single job involves a plurality of sheets undergoing consecutive image formation processes, the first transfer power supply circuit 202 and the second transfer supply circuit 203 continue to supply transfer power during a period from the initiation of first transfer operation to a first sheet in the image forming section most upstream with respect to the traveling direction of the intermediate transfer belt 11 to the passage through the second transfer region of a tail end of a last sheet.

Figure 4:
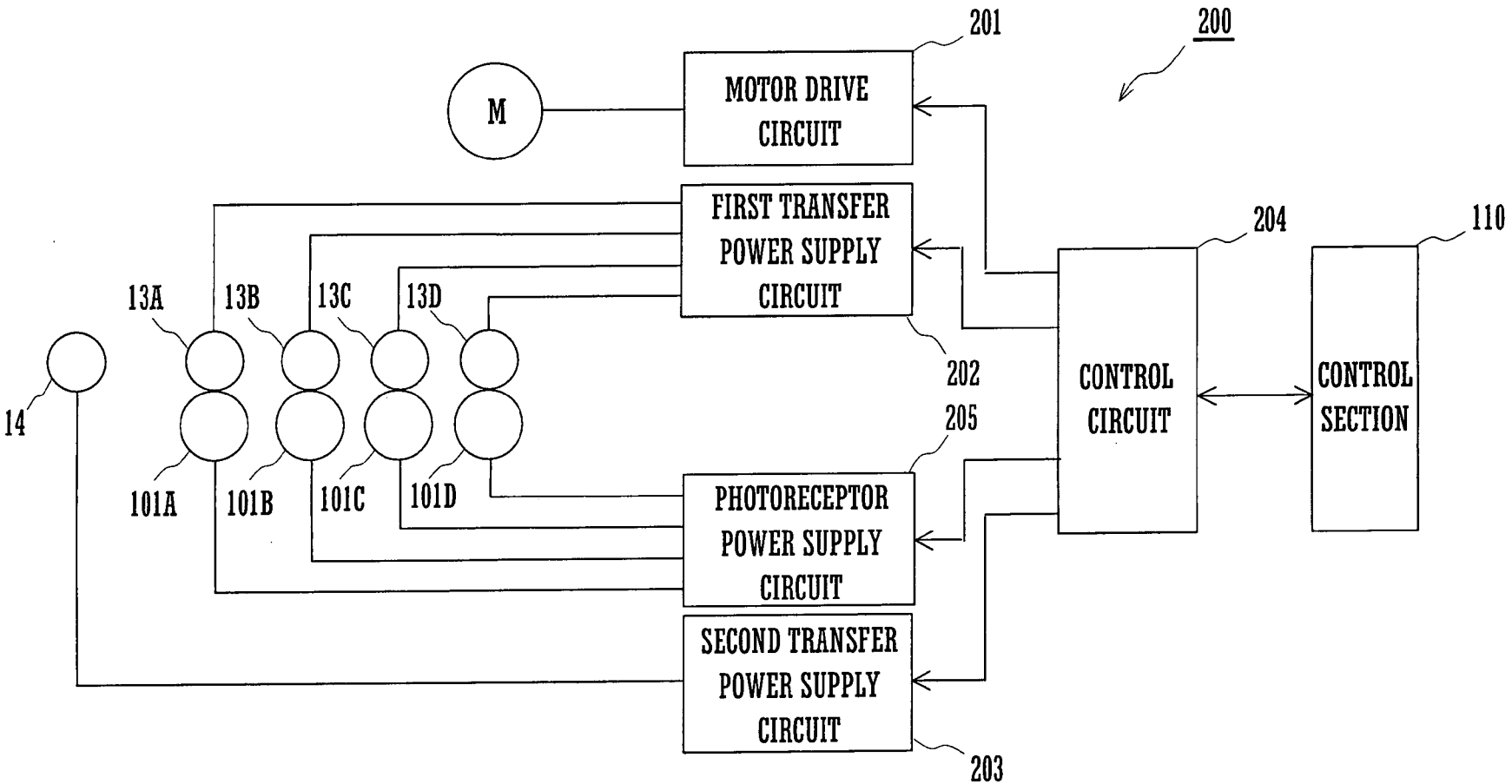
FIG. 4 is a block diagram illustrating a construction of a transfer device according to a second embodiment of the present invention.

FIG. 4 is a block diagram illustrating a construction of a transfer device 200 according to a second embodiment of the present invention. The transfer device 200 is provided with a photoreceptor power supply circuit 205 for applying a predetermined level of voltage to the photoreceptor drums 101A to 101D, as well as the components as illustrated in FIG. 2. The voltage applied from the circuit 205 to the drums 101A to 101D has such polarity and value as to prevent extra toners from being attracted to the photoreceptor drums 101A to 101D. More specifically, the circuit 205 applies a high voltage having the same polarity as the toners to a conductive base material of the photoreceptor drums 101A to 101D.

Figure 5:
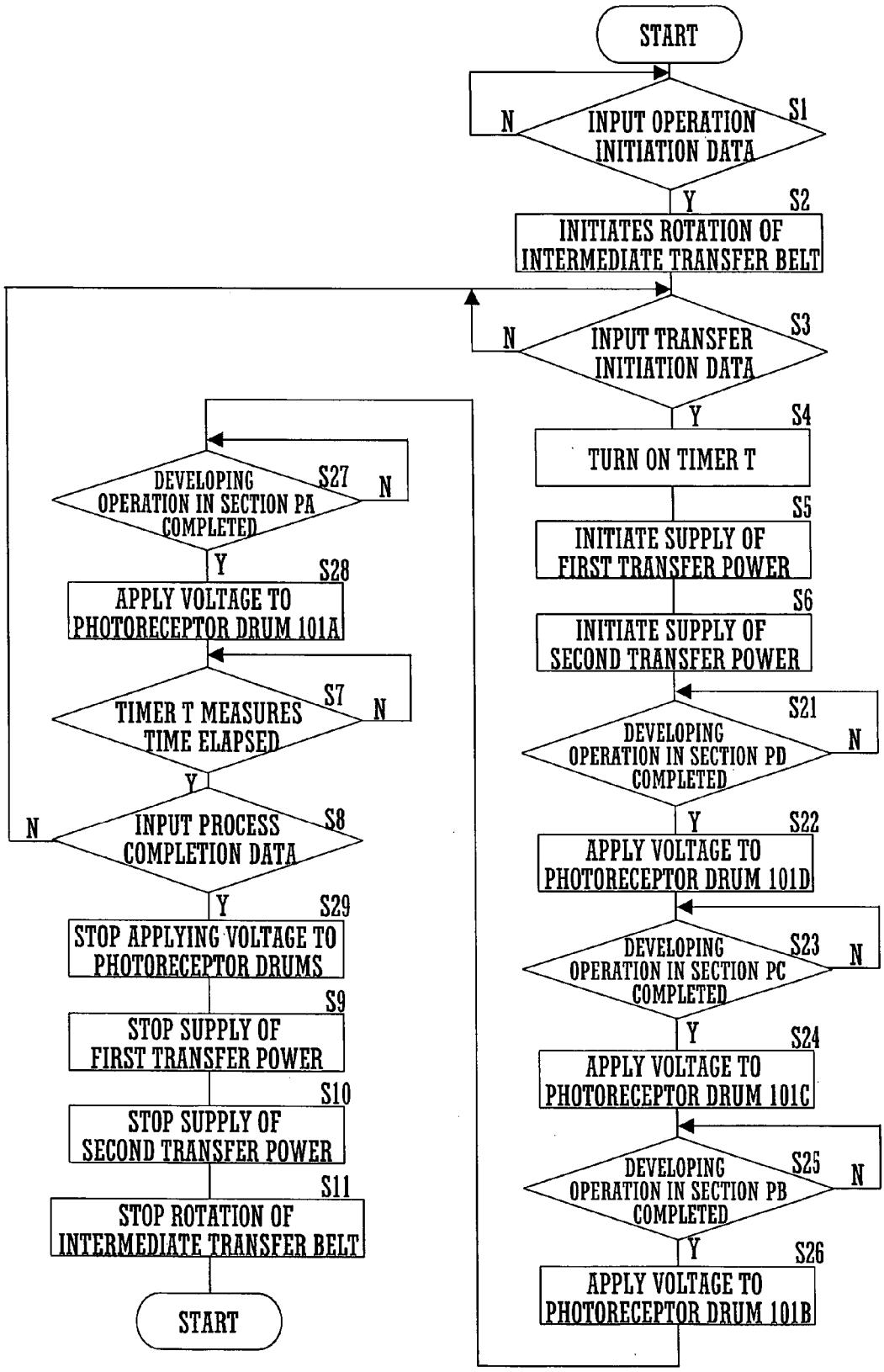
FIG. 5 is a flowchart illustrating processing steps performed in full-color image formation by a control circuit of the transfer device according to the second embodiment.

FIG. 5 is a flowchart illustrating part of processing steps performed by the control circuit of the transfer device 200 according to the second embodiment. In addition to the processing steps as illustrated in FIG. 3, the control circuit 204 of the transfer device 200 follows processing steps (steps S21 to S28, and S29) of applying a predetermined level of voltage to the photoreceptor drums 101A to 101D, respectively, through the photoreceptor power supply circuit 205 within a period from the completion of developing operation in each of the image forming sections PA to PD to the completion of the second transfer operation. The completion of developing operation in each of the sections PA to PD is determined by measuring a predetermined time period from the moment the operation initiation data is input in step S1.

When the first transfer rollers in the image forming sections which have completed the first transfer operation have a continued supply of transfer power, the application of voltage thus prevents extra toners from being transferred from the photoreceptor drums 101A to 101D to the intermediate transfer belt 11. Toners are thus prevented from being consumed wastefully or from contaminating the interior of the image forming apparatus.

In the monochromatic image formation, the control circuit 204 applies the predetermined level of voltage through the photoreceptor power supply circuit 205 to only the photoreceptor drum 101A in the image forming section PA.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transfer device comprising:

an endless intermediate transfer belt following a loop path;

an image carrier for a toner image to be formed in an electrophotographic method; and a control section for controlling first and second transfer operations performed in first transfer regions and a second transfer region during one full rotation of the loop path by the intermediate transfer belt by simultaneously initiating, and simultaneously stopping, a supplying of predetermined levels of transfer power to all of the first transfer regions where the toner image is transferred from the image carrier to the intermediate image transfer belt and to a second transfer region where the toner image is transferred from the intermediate transfer belt to a record medium.

2. A transfer device according to claim 1, wherein the control section initiates supplying said predetermined transfer power levels to all of the first transfer regions and to the second transfer region upon initiation of a first transfer operation in the one of the first transfer regions positioned most upstream with respect to a traveling direction of the intermediate transfer belt.

3. A transfer device according to claim 1, wherein the control section initiates supplying said predetermined transfer power levels to all of the first transfer regions and to the second transfer region upon initiation of a toner image formation on the image carrier in the one of the first transfer regions positioned most upstream with respect to a traveling direction of the intermediate transfer belt.

4. A transfer device according to claim 1, wherein the control section stops supplying said transfer power levels to all of the first transfer regions and to the second transfer region upon completion of the second transfer operation in the second transfer region.

5. A transfer device according to claim 1, wherein the control section applies to the image carrier power for preventing extra toners from being attracted to the image carrier during a period from completion of toner image formation on the image carrier to completion of the second transfer operation.

6. A transfer device according to claim 1, wherein the intermediate transfer belt has a resistance of $1\times10^{11}$ to $1\times10^{13}$ Ω·cm.

* * * * *